US005851123A

United States Patent [19]

Chou

[11] Patent Number: 5,851,123

[45] Date of Patent: Dec. 22, 1998

[54] MULTIPLE SOCKET COMPATIBLE PLUG

[76] Inventor: Chin Wen Chou, 4th Fl., No. 42, Alley 30, Lane 284, Wu Hsing Street, Taipei, Taiwan

[21] Appl. No.: 775,240

[22] Filed: Dec. 30, 1996

[51] Int. Cl.[6] ..... H01R 29/00

[52] U.S. Cl. ..... 439/172; 439/694

[58] Field of Search ..... 439/103, 171, 439/172, 173, 221, 222, 289, 694, 695, 696, 700, 824, 956

[56] References Cited

U.S. PATENT DOCUMENTS 5,529,510 6/1996 Wakata et al. ..... 439/824
5,641,292 6/1997 Fann ..... 439/103

*Primary Examiner*—Neil Abrams
*Assistant Examiner*—Yong Ki Kim
*Attorney, Agent, or Firm*—Friedman Siegelbaum LLP

[57] ABSTRACT

A socket-compatible plug which includes a plug body with a plurality of holes, plurality of plug pins respectively insertable into selected ones of the plurality holes, and a medium mounted into respective selected ones of the plural holes for urging selected ones of the plurality of plug pins beyond the respectively selected ones of the plurality of holes. The plug further includes a back cover. The plurality of holes of the plug body includes a medium-mounting hole and the selected ones of the plurality of holes. Each of the selected ones can include a plug pin positioning region and a medium positioning region. The plug pin positioning region can include an upper edge and the plug pin includes a flange engaged with the upper edge. The back cover urges the medium to the medium positioning region, while the plug body is assembled with the back cover.

16 Claims, 7 Drawing Sheets

MULTIPLE SOCKET COMPATIBLE PLUG

FIELD OF THE INVENTION

The present invention relates to a multiple socket plug which is compatible with various sockets around the world.

BACKGROUND OF THE INVENTION

The most popular plug is designed to fit a specific type of socket, i.e. the plug pins are immovably mounted on fixed positions on the plug so that a specific plug is suitable for a unique type of socket. It is not unusual for an international traveler to find a socket that may be not compatible with the plug of his notebook computer or electric shaver, etc., and thus it would be inconvenient for him to use his electric appliance. Previous measures overcome the difficulty have included adding an adapter plug mounted on the plug. However, it is difficult and troublesome for a passenger to buy many adapter plugs that are required in different nations of the world.

Applicant has tried to deal with the above shortcoming suffered by the international passenger.

SUMMARY OF THE INVENTION

It is therefore an object of the present invention to provide a more convenient and general plug compatible with various sockets.

It is therefore another object of the present invention to provide a device or a plug which can be used in different countries, and which adjusts its plug pins easily for different types of sockets and frees the traveler from buying any adapter plug.

According to the present invention, a multiple socket compatible plug includes a plug body with a plurality of holes, a plurality of plug pins respectively insertable into selected ones of the plurality of holes, and a medium mounted into the respectively selected ones of the plurality of holes for urging selected ones of the plurality of plug pins beyond the respectively selected ones of the plurality of holes.

Preferably, the present plug further includes a back cover.

Preferably, the plural holes of the plug body include a medium-mounting hole and the selected ones of the plurality of holes.

Certainly, each of the selected ones of the plurality of holes can include a plug pin positioning region and a medium positioning region.

Certainly, the plug pin positioning region can include an upper edge and the plug pin includes a flange engaged with the upper edge.

Preferably, the back cover urges the medium to the medium positioning region, while the plug body is assembled with the back cover.

Preferably the plug is assembled by a screw or an assembling device.

Certainly, the assembling device can include a lug formed on the back cover, a recess formed on the plug body for receiving the lug, a retainer formed on the back cover and a retainer engaging edge mounted on the plug body to be engaged with the retainer.

Certainly, the medium can urge the selected ones of the plurality of plug pins to the plug pin positioning region.

Preferably, the medium includes two or three conducting tubes.

Of course, the electric wire can be connected to a conducting element rather than the two or three conducting tubes.

Certainly, the conducting element can be connected to the medium and mounted on the back cover.

Certainly, the conducting element can include two or three conducting plates.

Preferably, the two or three conducting plates respectively urge the two or three conducting tubes.

Preferably, the medium may include an unselected conducting tube put into the mediummounting hole.

Certainly, the plug pin can be a metal conductor.

Certainly, the conducting element can be a metal plate.

Preferably, the metal plate is made of copper.

BRIEF DESCRIPTION OF DRAWINGS

The present invention may best be understood through the following description with reference to the accompanying drawings, in which:

FIG. 1(*b*) is a perspective apparent view showing a multiple socket compatible plug in FIG. 1(*a*);

FIG. 1(*c*) is a sectionally perspective view of a multiple socket compatible plug in FIG. 1 (*a*);

FIG. 1(*d*) is a sectionally perspective view of a multiple socket compatible plug having plural plug pins according to present invention;

FIG. 1 (*e*) and (*f*) are perspective views showing two embodiments of plug pins for a multiple socket compatible plug according to the present invention;

DETAILED DESCRIPTION OF THE PREFERRED EMBODIMENTS

Preferred Embodiment 1

Figure 1A:
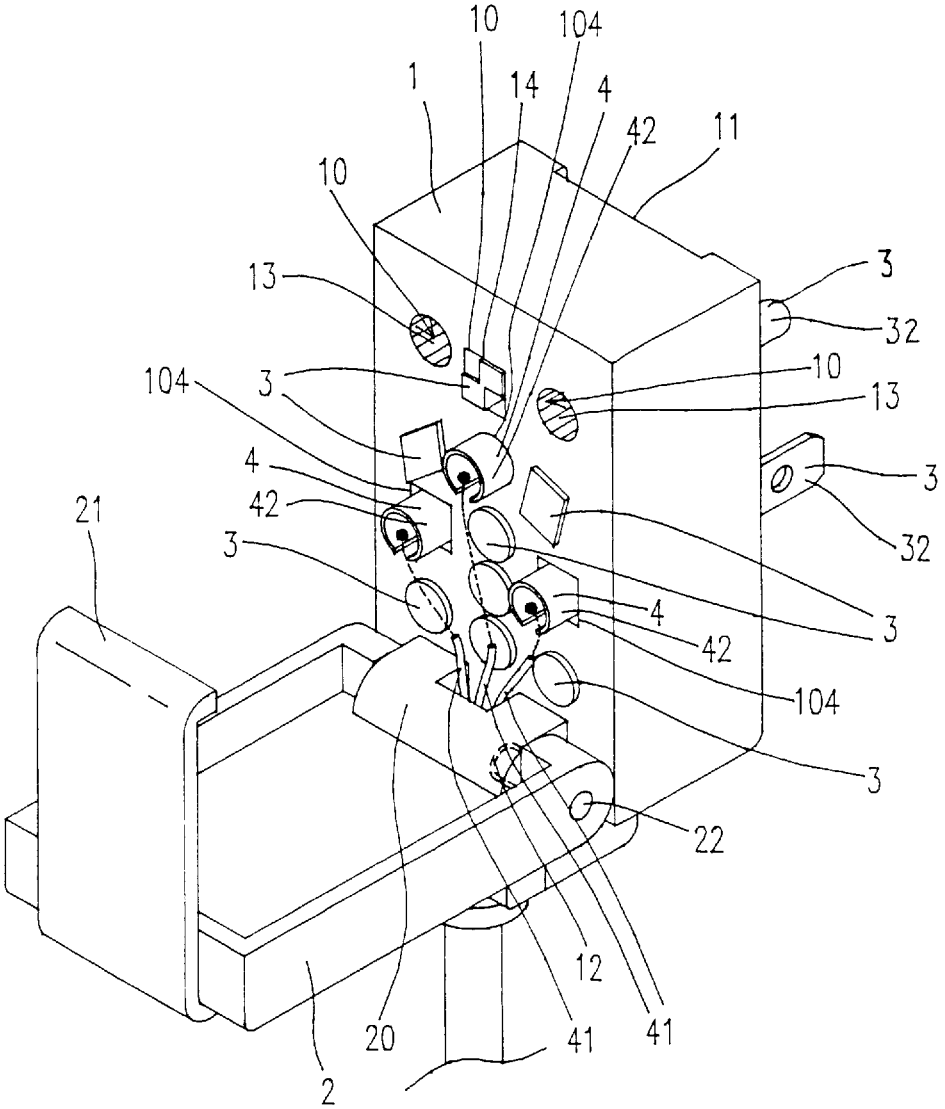
FIG. 1(*a*) is a perspective view showing a preferred embodiment of a multiple socket compatible plug according to the present invention.
Figure 1B:
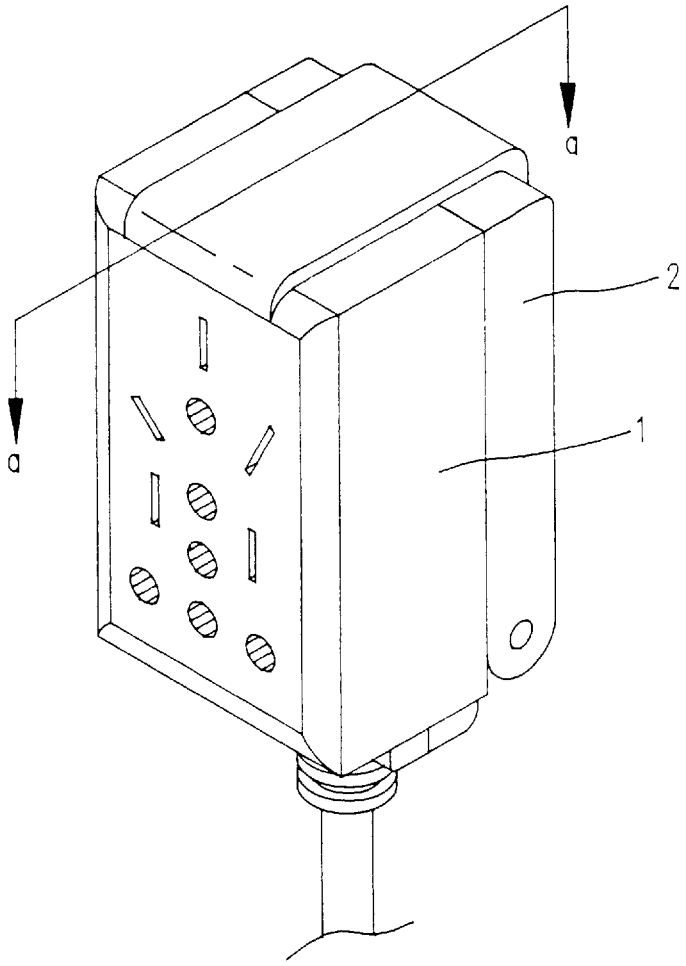
Figure 1C:
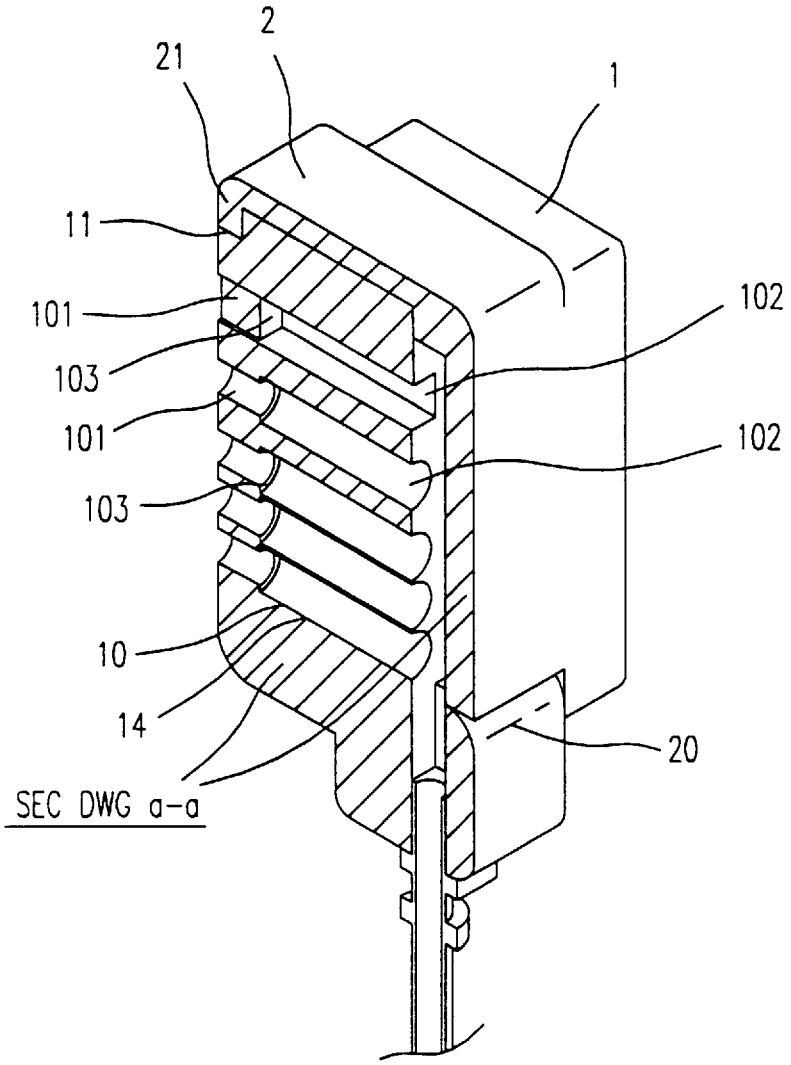
Figure 1D:
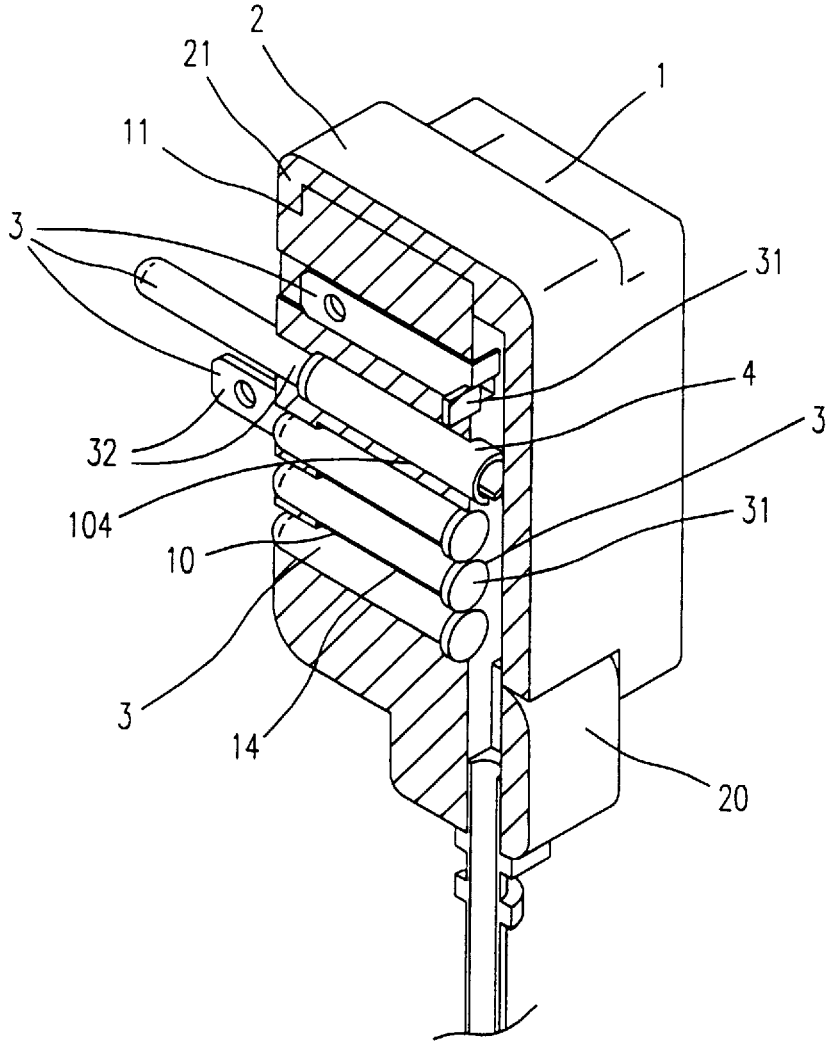
Figure 1F:
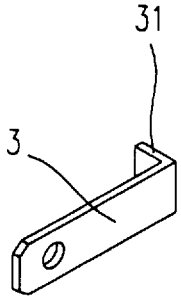
Figure 1E:
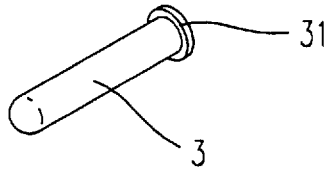

FIG. 1 (*a*) is a perspective view showing an application of a Preferred Embodiment 1 of a multiple socket compatible plug according to the present invention. The multiple socket compatible plug includes a plug body 2 with plural holes 10, plural plug pins 3 respectively insertable into selected ones 14 of plural holes 10, and a medium 4 mounted into respectively selected ones 104 of the plural holes 10 for urging selected ones 32 of plural plug pins 3 beyond respectively selected ones 104 of the plural holes 10. A back cover 2 assembled with the plug body 1 includes the plurality of holes 10 having the medium-mounting holes 13 and the selected ones 14 of the plurality of holes 10.

FIGS. 1(*b*) and 1(*c*) are respectively a perspective and a sectionally perspective views of the preferred embodiment 1 of the multiple socket compatible plug according to the present invention. Each of the selected ones 14 of the plural holes 10 includes a plug pin positioning region 101 and a medium positioning region 102. The plug pin positioning region 101 includes an upper edge 103. The back cover 2 urges the medium 4 to the medium positioning region 102 while the plug body 1 is assembled with the back cover 2.

Of course, the plug can be assembled by a screw and an assembling device 20. The assembling device 20 includes a lug 22 formed on the back cover 2, a recess 12 formed on the plug body 1 for receiving therein the lug 22, a retainer 21 formed on the back cover 2 and a retainer engaging edge 11 mounted on the plug body 1 to be engaged with the retainer 21. The medium 4 urges the selected ones 32 of the plurality of plug pins 3 to the plug pin positioning region 101 after the back cover 2 urges the medium 4 while the plug is assembled. The medium 4 includes two or three conducting tubes 42 which is connected to the electric wire 41.

FIG. 1(*d*) is a sectionally perspective view of the preferred embodiment 1 of a socket-compatible plug, having a plurality of plug pins 3 which can be in the forms respectively shown in FIGS. 1(*e*) and 1(*f*) according to the present invention. The plug pin 3 includes a flange 31 to be engaged with the upper edge 103 of the plug pin positioning region 101.

Preferred Embodiment 2

Figure 2:
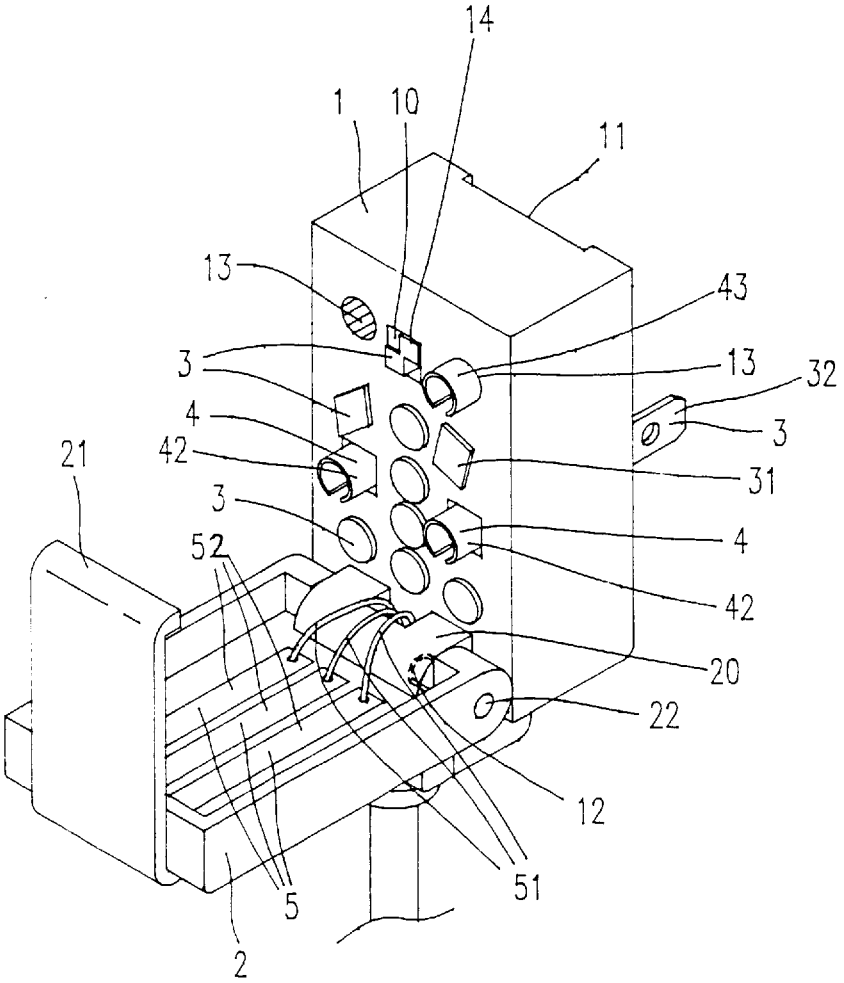
FIG. 2 is a perspective view showing another preferred embodiment of a multiple socket compatible plug according to the present invention.

FIG. 2 is a perspective view showing another application of a Preferred Embodiment 2 of a socket-compatible plug according to the present invention. In an analogous way, the back cover 2 urges the medium 4 to the medium positioning region 102, while the plug body 1 is assembled with the back cover 2. The plug can be assembled by a screw and an assembling device 20. The assembling device 20 includes a lug 22 formed on the back cover 2, a recess 12 formed on the plug body 1 for receiving therein the lug 22, a retainer 21 formed on the back cover 2 and a retainer engaging edge 11 mounted on the plug body 1 to be engaged with the retainer 21. The medium 4 urges the selected ones 32 of the plural plug pins 3 to the plug pin positioning region 101. The medium 4 includes two or three conducting tubes 42.

Of course, the electric wire 51 can be connected to a conducting element 5 rather than the two or three conducting tubes 42. The conducting element 5 is connected to the medium 4 and is mounted on the back cover 2. The conducting element 5 includes two or three conducting plates 52 which respectively urge the two or three conducting tubes 42 while the plug is assembled. The medium 4 includes an unselected conducting tube 43 put into the medium-mounting hole 13. The plug pin 3 is a metal conductor. The conducting element 5 includes three metal plates 52 which are made of copper.

Preferred Embodiments 3 and 4

Figure 4:
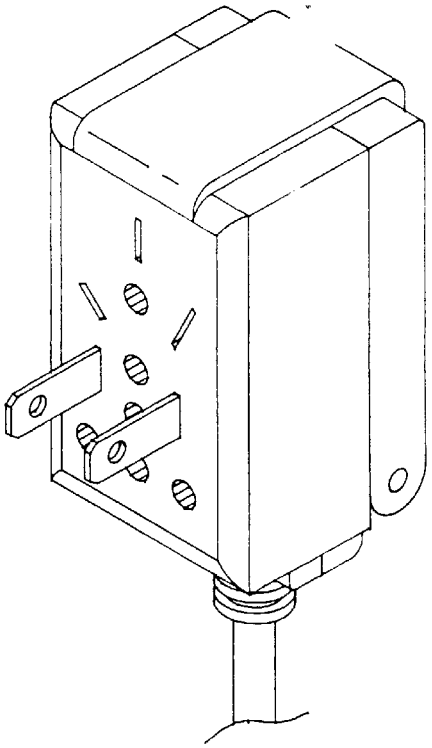
FIG. 3 and FIG. 4 are perspective views showing two further preferred embodiments of multiple socket compatible plugs used in Taiwan, Japan, America, Canada, Philippines and Thailand according to the present invention.
Figure 3:
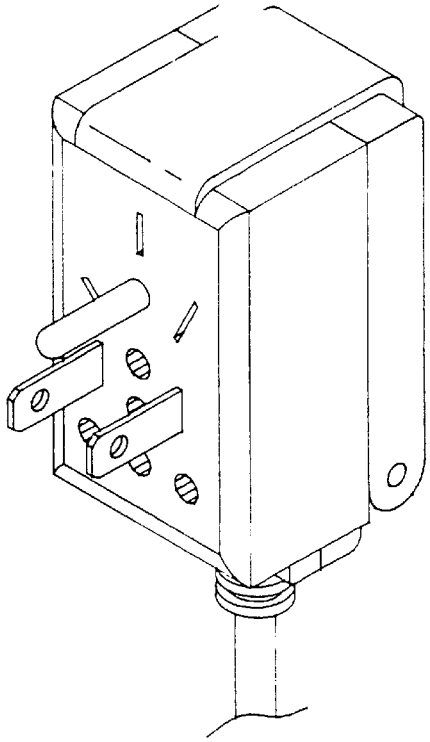

Please refer to FIG. 3 and 4 which are perspective views showing two further preferred embodiments of a multiple socket compatible plug used in Taiwan, Japan, America, Canada, Philippines and Thailand according to the present invention.

Preferred Embodiment 5

Figure 5:
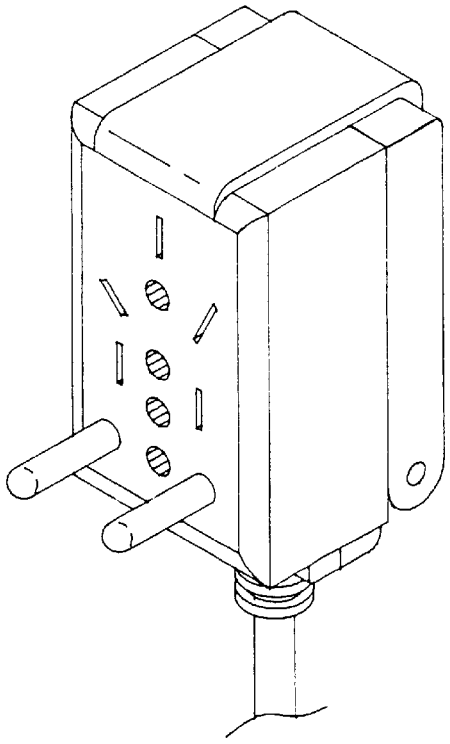
FIG. 5 is a perspective view showing a preferred embodiment of a multiple socket compatible plug used in Russia, Middle East, Chinese Mainland and South America according to the present invention.

FIG. 5 is a perspective view showing another preferred embodiment of a multiple socket compatible plug used in Russia, Middle East, Mainland China and South America according to the present invention.

Preferred Embodiment 6

Figure 6:
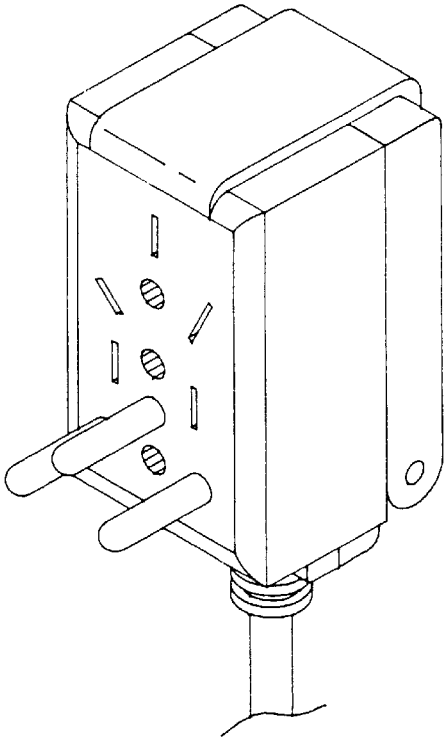
FIG. 6 is a perspective view showing a preferred embodiment of a multiple socket compatible plug used in Swiss according to the present invention.

FIG. 6 is a perspective view showing another preferred embodiment of a multiple socket compatible plug used in Switzerland according to the present invention.

Preferred Embodiment 7

Figure 7:
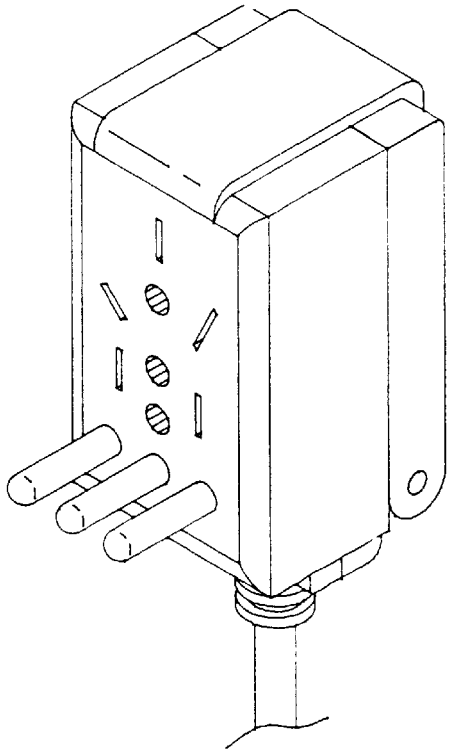
FIG. 7 is a perspective view showing a preferred embodiment of a multiple socket compatible plug used in Italy according to the present invention.

FIG. 7 is a perspective view showing yet another preferred embodiment of a multiple socket compatible plug used in Italy according to the present invention.

Preferred Embodiment 8

Figure 8:
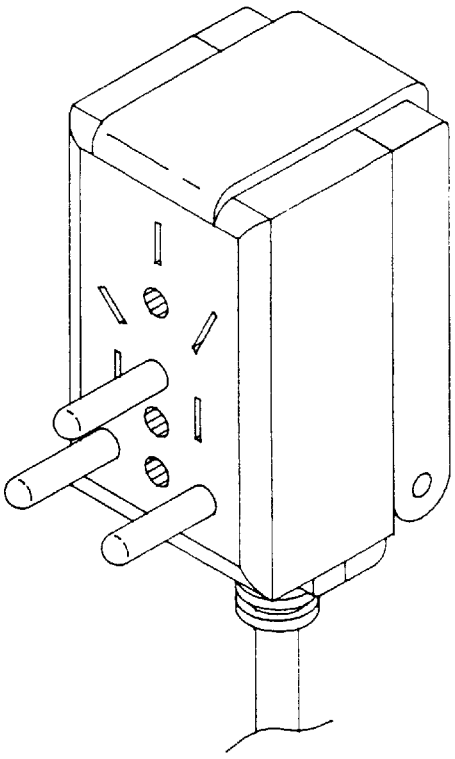
FIG. 8 is a perspective view showing a preferred embodiment of a multiple socket compatible plug used in Middle East according to the present invention.

FIG. 8 is a perspective view showing a further preferred embodiment of a multiple socket compatible plug used in Middle East according to the present invention.

Preferred Embodiments 9 and 10

Figure 10:
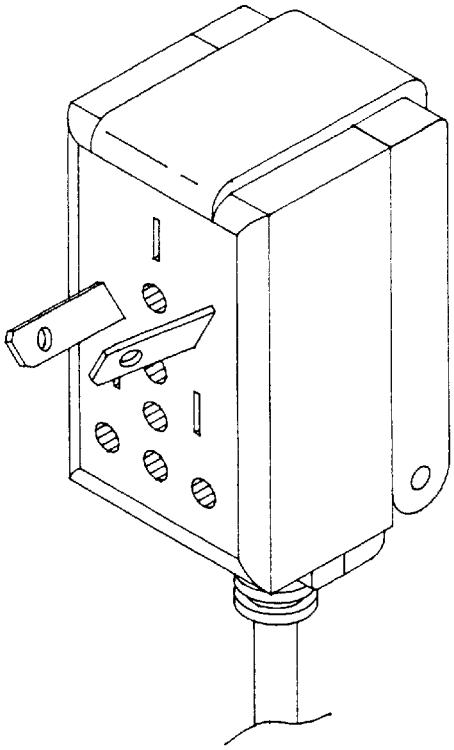
FIG. 9 and FIG. 10 are perspective views showing preferred embodiments of a multiple socket compatible plug used in Australia, New Zealand and Chinese Mainland according to the present invention.
Figure 9:
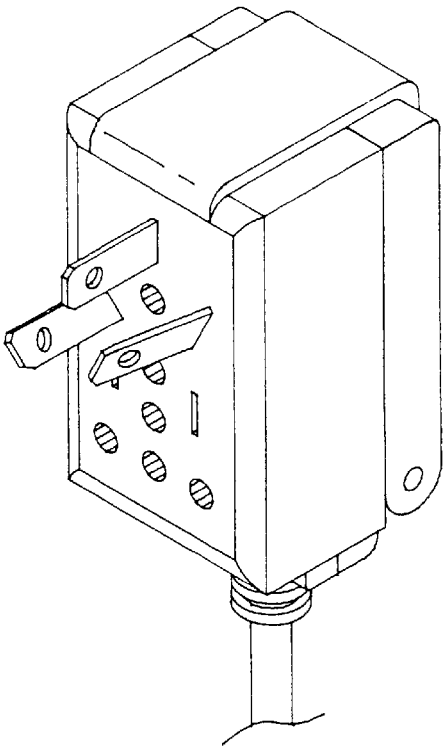

FIG. 9 and FIG. 10 are perspective views showing yet a further preferred embodiment of a multiple socket compatible plug used in Australia, New Zealand and Mainland China according to the present invention.

While the invention has been described in terms of what are considered to be the most practical and preferred embodiments, it is to be understood that the invention need not be limited to the disclosed embodiments. On the contrary, it is intended to cover various modifications and arrangements included within the spirit and scope of the appended claims which are to be accorded with the broadest interpretation so as to encompass all such modifications and equivalent structures.

What I claim is:

1. A multiple socket compatible plug comprising:

a plug body with a plurality of holes;

plural plug pins respectively insertable into selected ones of said plurality of holes; and a medium having at least two conducting tubes mounted into said respectively selected ones of said plurality of holes for urging selected ones of the plurality of plug pins beyond the respectively selected ones of said plurality of holes.

2. A plug according to claim 1, further comprising a back cover.

3. A plug according to claim 2 wherein said plurality of holes comprise a medium-mounting hole and said selected ones of said plurality of holes.

4. A plug according to claim 3 wherein each of said selected ones of said plurality of holes comprises a plug pin positioning region and a medium positioning region.

5. A plug according to claim 4 wherein said plug pin positioning region comprises an upper edge and said plug pin comprises a flange to be unengaged with said upper edge.

6. A plug according to claim 5 wherein said back cover urges said medium to said medium positioning region while said plug body is assembled with said back cover.

7. A plug according to claim 6 wherein said plug is assembled by one of a screw and an assembling device.

8. A plug according to claim 7 wherein said assembling device comprises:

a lug formed on said back cover;

a recess formed on said plug body for receiving therein said lug;

a retainer formed on said back cover; and a retainer engaging edge mounted on said plug body to be engaged with said retainer.

9. A plug according to claim 8 wherein said medium urges said selected ones of said plurality of plug pins to said plug pin positioning region.

10. A plug according to claim 9, further comprising a conducting element connected to said medium and mounted on said back cover.

11. A plug according to claim 10 wherein said conducting element comprises at least two conducting plates.

12. A plug according to claim 11 wherein said at least two conducting plates respectively urge said at least two conducting tubes.

13. A plug according to claim 12 wherein said medium comprises an unselected conducting tube put into said medium-mounting hole.

14. A plug according to claim 12 wherein said plug pin is a metal conductor.

15. A plug according to claim 11 wherein said conducting element is a metal plate.

16. A plug according to claim 15 wherein said metal plate is made of copper.

* * * * *